US006822590B2

(12) United States Patent
Kusaka

(10) Patent No.: US 6,822,590 B2
(45) Date of Patent: Nov. 23, 2004

(54) PRINTING QUALITY CHECKING APPARATUS OF PRINTING PRESS

(75) Inventor: Akehiro Kusaka, Chiba (JP)

(73) Assignee: Komori Corporation, Tokyo (JP)

( * ) Notice: Subject to any disclaimer, the term of this patent is extended or adjusted under 35 U.S.C. 154(b) by 6 days.

(21) Appl. No.: 10/325,879

(22) Filed: Dec. 23, 2002

(65) Prior Publication Data

US 2003/0122914 A1 Jul. 3, 2003

(30) Foreign Application Priority Data

Dec. 27, 2001 (JP) ..... 2001-396608
Jan. 28, 2002 (JP) ..... 2002-018004

(51) Int. Cl.[7] ..... B41J 2/01
(52) U.S. Cl. ..... 341/104
(58) Field of Search ..... 347/104, 101, 347/164, 154, 240, 251, 262, 264; 400/578; 226/10; 399/361; 346/134, 136

(56) References Cited

U.S. PATENT DOCUMENTS 6,106,094 A * 8/2000 Otani et al. ..... 347/19
2001/0027730 A1 10/2001 Kamoda

FOREIGN PATENT DOCUMENTS

| | | | |
|---|---|---|---|
| EP | 0286317 | A1 | 10/1988 |
| EP | 1142712 | A1 | 10/2001 |
| JP | 2001-287344 | A | 10/2001 |

* cited by examiner

*Primary Examiner*—Raquel Yvette Gordon
(74) *Attorney, Agent, or Firm*—Birch, Stewart, Kolasch & Birch, LLP

(57) ABSTRACT

A printing press comprises transport means for transporting a printed sheet to a delivery unit, face-side and reverse-side UV devices for drying an ultraviolet curing ink printed on the sheet transported by the transport means, and a printing quality checking apparatus for checking the printed surfaces of the sheet transported by the transport means. Face-side and reverse-side checking cameras of the printing quality checking apparatus are provided at positions where the face-side and reverse-side checking cameras are not affected by heat and/or light from the face-side and reverse-side UV devices. The printing quality checking apparatus can reliably prevent improper operation and wrong detection of the face-side and reverse-side checking cameras without being adversely affected by heat or light from the face-side and reverse-side UV devices.

12 Claims, 8 Drawing Sheets

PRINTING QUALITY CHECKING APPARATUS OF PRINTING PRESS

The entire disclosure of Japanese Patent Application No. 2001-396608 filed on Dec. 27, 2001 and Japanese Patent Application No. 2002-18004 filed on Jan. 28, 2002 including specification, claims, drawings, and summary is incorporated herein by reference in its entirety.

BACKGROUND OF THE INVENTION

1. Field of the Invention

This invention relates to a printing press having a drying device, which dries ink, and a printing quality checking apparatus, which checks the printed surface of a sheet of paper, on a transport path for printing products produced by printing.

2. Description of the Related Art

So far, there has been a printing press equipped with a drying device and a printing quality checking apparatus as disclosed, for example, in Japanese Unexamined Patent Publication No. 2001-287344. In this printing press, as shown in FIG. 13, printed sheets are transported along a transport path indicated by arrows in the drawing, i.e., first delivery chain 100→first to third transfer cylinders 101 to 103→second delivery chain 104, and are finally piled on a delivery pile board 106 of a delivery unit 105. On this transport path for the printed sheets, dryers (drying devices) 109 and 110 are disposed for the first transfer cylinder 101 and the second transfer cylinder 102 upstream from checking cameras (printing quality checking apparatuses) 107 and 108 in order to prevent smears during perfecting printing. Usually, an anti-setoff sheet (not shown) is wrapped round the circumferential surface of the first transfer cylinder 101.

With the above-described printing press, the checking camera 107 and the dryer 109 (and the checking camera 108 and the dryer 110) are installed at relatively close positions about 90° apart from each other around the transfer cylinder 101 (and the transfer cylinder 102). Thus, the heat of the dryer 109 (110) adversely affects the checking camera 107 (108), causing improper operation of the checking camera 107 (108). When UV devices (drying devices for ultraviolet curing) are used as the dryers 109, 110, the checking cameras 107, 108 need to be installed normally about 1,000 mm apart from the UV devices, and at least about 500 mm apart from them.

In the case of the dryers 109, 110 using light such as ultraviolet radiation or infrared radiation, the light from the dryers 109, 110 enters the checking cameras 107, 108, resulting in the wrong detection of the checking cameras 107, 108.

Particularly at the site of grippers of the transfer cylinders 101, 102, light is reflected diffusely. The diffusely reflected light is apt to enter the checking cameras 107, 108, and wrong detection is liable to occur.

SUMMARY OF THE INVENTION

The present invention has been accomplished in the light of the above-described situations. It is the object of the invention to provide a printing quality checking apparatus of a printing press which can reliably prevent the improper operation and wrong detection of a detector without being adversely affected by heat or light from a dryer.

According to the present invention, for attaining the above object, there is provided a printing quality checking apparatus of a printing press, the printing press comprising:

transport means for transporting a printing product, which has been produced by printing, to a delivery unit; a drying device for drying ink printed on the printing product transported by the transport means; and the printing quality checking apparatus for checking a printed surface of the printing product transported by the transport means, wherein a detector of the printing quality checking apparatus is provided at a position where the detector is not affected by heat of the drying device.

Thus, the improper operation and wrong detection of the detector can be prevented reliably, and the reliability of the printing quality checking apparatus can be increased.

In the printing quality checking apparatus, the detector of the printing quality checking apparatus may be provided at a position where the detector is not affected by light from the drying device.

In the printing quality checking apparatus, the printing press may be a perfecting printing press, and the drying device and the detector of the printing quality checking apparatus may be provided for each of the face side and the reverse side of the printing product.

In the printing quality checking apparatus, the transport means may be composed of at least two transport cylinders, the drying device may be provided opposing the circumferential surface of one of the transport cylinders, and the detector of the printing quality checking apparatus may be provided opposing the circumferential surface of the other transport cylinder.

In the printing quality checking apparatus, the at least two transport cylinders may have a larger diameter than the diameter of an ordinary plate cylinder.

In the printing quality checking apparatus, the transport means may be composed of at least one transport cylinder, the drying device may be provided opposing the circumferential surface of the transport cylinder, and the detection surface of the detector of the printing quality checking apparatus may be provided in a range in which light from the drying device is blocked by the transport cylinder.

In the printing quality checking apparatus, the transport means may be composed of at least one transport cylinder and at least one endless transport device, the drying device may be provided opposing the transport path of the endless transport device, and the detector of the printing quality checking apparatus may be provided opposing the circumferential surface of the transport cylinder.

In the printing quality checking apparatus, the transport means may be composed of at least one endless transport device, the drying device may be provided opposing the transport path of the endless transport device, and the detector of the printing quality checking apparatus may be provided opposing the transport path of the endless transport device, and may be provided at a position 500 mm or more apart from the position of the drying device.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of the printing quality checking apparatus of the printing press according to the present invention will now be described in detail with reference to the accompanying drawings, which in no way limit the invention.

First Embodiment

Figure 1:
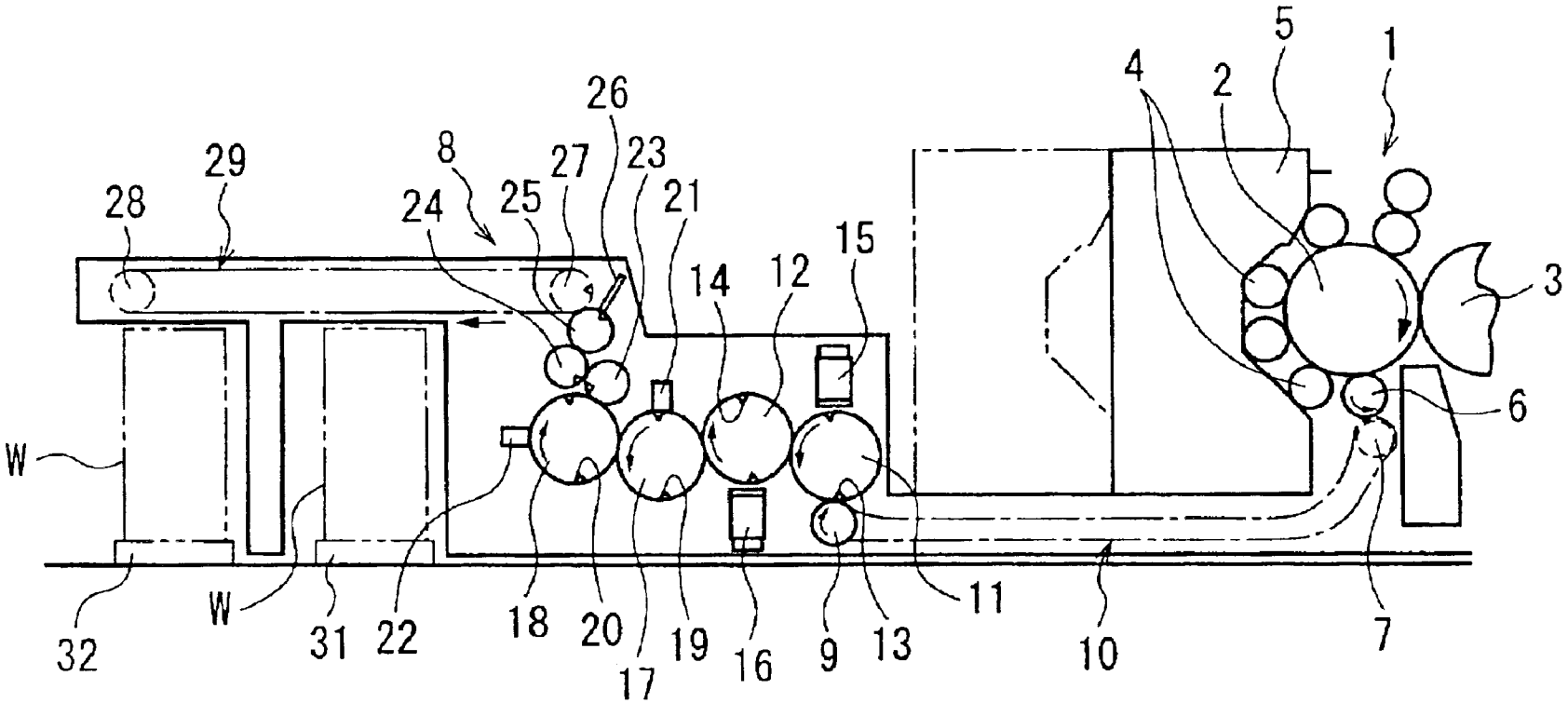
FIG. 1 is a side view of the essential parts of a four-color perfecting printing press showing a first embodiment of the present invention.
Figure 2:
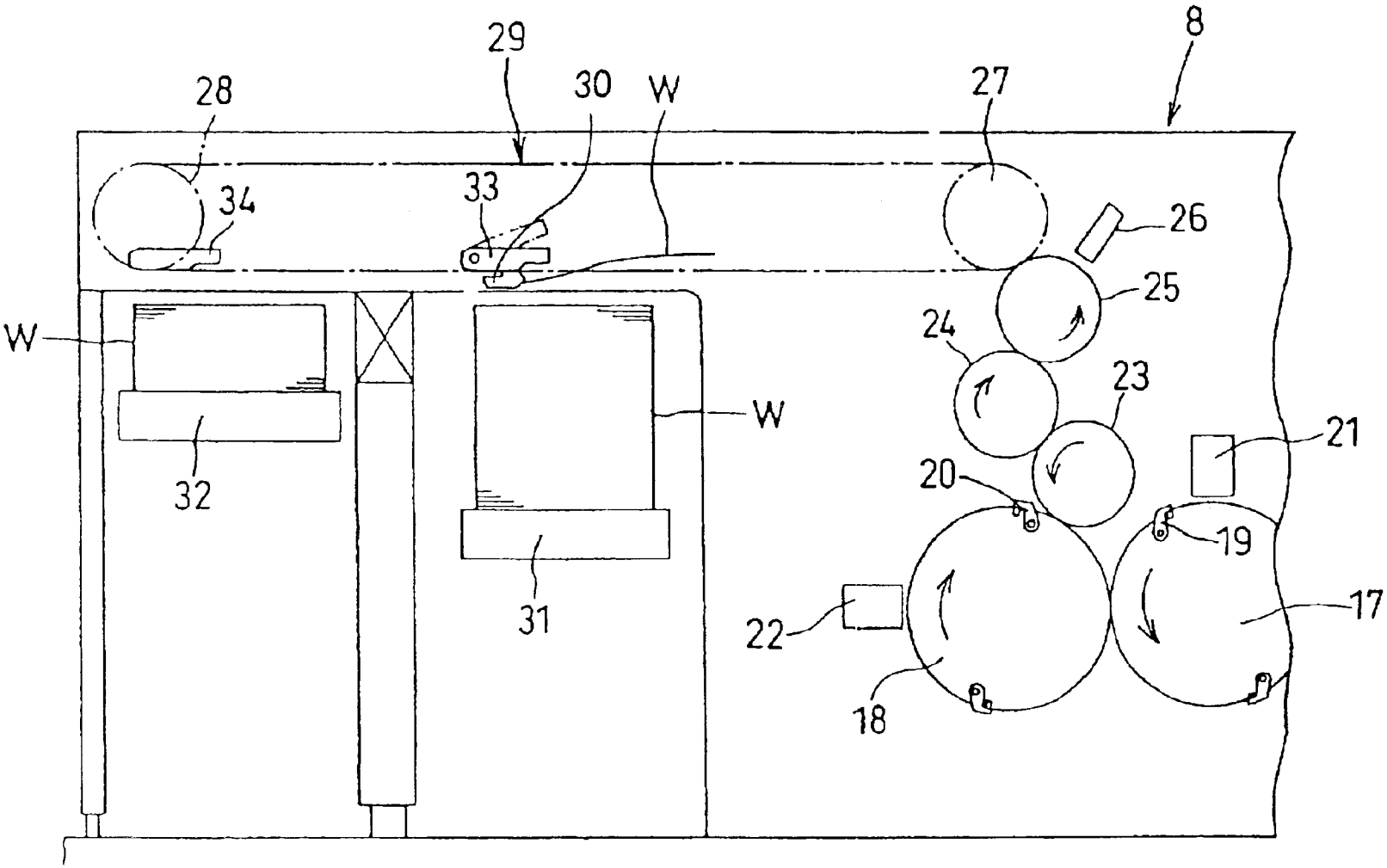
FIG. 2 is an enlarged side view of a delivery unit in the essential parts of the printing press.

FIG. 1 is a side view of the essential parts of a four-color perfecting printing press showing a first embodiment of the present invention. FIG. 2 is an enlarged side view of a delivery unit in the essential parts of the printing press.

In a printing unit 1 of a four-color perfecting printing press, as shown in FIG. 1, a blanketed impression cylinder 2 having a gripper device (not shown), and a blanket cylinder 3 having no gripper device are rotatably supported in a nearly horizontal state such that their circumferential surfaces are in contact. Four plate cylinders 4 are disposed on the circumferential surface of the blanketed impression cylinder 2. Similarly, four plate cylinders (not shown) are disposed on the circumferential surface of the blanket cylinder 3. Inking units 5, free to contact and leave the plate cylinders 4, are provided movably so as to be capable of supplying ink and water while making contact with the plate cylinders 4.

A sheet of paper (printing product) W, printed on both sides by the blanketed impression cylinder 2 and the blanket cylinder 3, is gripped by a gripper device (not shown) of a transfer cylinder 6. Then, the sheet W is gripped by a delivery gripper member (not shown) of a first delivery chain (endless transport device) 10 looped between a delivery cylinder 7 of the printing unit 1 and a delivery cylinder 9 of a delivery unit 8, and is thereby transported to the delivery unit 8.

The delivery unit 8 is provided with a first drying cylinder (transport cylinder) 11 of a large diameter in contact with the delivery cylinder 9, and a second drying cylinder (transport cylinder) 12 of a large diameter in contact with the first drying cylinder 11. These drying cylinders 11 and 12 are provided with gripper devices 13 and 14, respectively. In the drawing, the numeral 15 denotes a face-side UV device (a drying device for ultraviolet curing) which irradiates the face side of the sheet W with ultraviolet radiation to dry an ultraviolet curing ink. The face-side UV device 15 is provided opposing the circumferential surface of the first drying cylinder 11. The numeral 16 denotes a reverse-side UV device (a drying device for ultraviolet curing) which irradiates the reverse side of the sheet W with ultraviolet radiation to dry an ultraviolet curing ink. The reverse-side UV device 16 is provided opposing the circumferential surface of the second drying cylinder 12. An anti-setoff sheet (not shown) is wrapped round the circumferential surface of the first drying cylinder 11.

As shown also in FIG. 2, there are also provided a first checking cylinder (transport cylinder) 17 of the same diameter in contact with the second drying cylinder 12, and a second checking cylinder (transport cylinder) 18 of the same diameter in contact with the first checking cylinder 17. These checking cylinders 17 and 18 are provided with gripper devices 19 and 20, respectively. In the drawing, the numeral 21 denotes a face-side checking camera (a detector of a printing quality checking apparatus) for checking the quality of the face side of the sheet W. The face-side checking camera 21 is provided opposing the circumferential surface of the first checking cylinder 17. The numeral 22 denotes a reverse-side checking camera (a detector of the printing quality checking apparatus) for checking the quality of the reverse side of the sheet W. The reverse-side checking camera 22 is provided opposing the circumferential surface of the second checking cylinder 18.

In the drawings, the numerals 23, 24 and 25 denote transfer cylinders which have gripper devices (not shown) and whose circumferential surfaces are in contact. The transfer cylinder 23 contacts the second checking cylinder 18, and these three transfer cylinders, 23, 24 and 25, are provided in a vertically zigzag form. The numeral 26 denotes an ink jet printer, which is provided close to the circumferential surface of the transfer cylinder 25 to print a bar code, as an identification mark, on a margin of the sheet W transported while being gripped by the gripper device of the transfer cylinder 25.

In an upper part of the delivery unit 8, a second delivery chain (endless transport device) 29 is looped between delivery cylinders 27 and 28 provided in a longitudinal direction. On the second delivery chain 29, delivery gripper members 30 for gripping and transporting the sheet W are supported at constantly spaced intervals. The numeral 31 is an acceptable product pile board which is provided below a nearly middle portion of the second delivery chain 29. The numeral 32 is a defective product pile board which is provided below a terminal portion of the second delivery chain 29. A delivery cam 33 is provided above the acceptable product pile board 31. The delivery cam 33 is supported so as to be movable by drive means (not shown) between an operating position indicated by solid lines in the drawing and a retreat position indicated by two-dot chain lines in the drawing.

When the delivery cam 33 is located at the operating position, a cam follower (not shown) of the delivery gripper member 30 running under the action of the second delivery chain 29 engages the delivery cam 33, whereupon gripping by the delivery gripper member 30 is released and the sheet W falls onto the acceptable product pile board 31. When the delivery cam 33 is located at the retreat position, the cam follower (not shown) of the delivery gripper member 30 that has run does not engage the delivery cam 33, so that the sheet W is transported while being gripped by the delivery gripper member 30. The numeral 34 denotes a fixed delivery cam provided above the defective product pile board 32. The cam follower of the delivery gripper member 30, which is running while gripping the sheet W without engaging the delivery cam 33, engages the fixed delivery cam 34. As a result, gripping by the delivery gripper member 30 is released, and the sheet W falls onto the defective product pile board 32.

Because of the above constructions, the sheet W after perfecting printing, which has been transported to the delivery cylinder 9 of the delivery unit 8 by the first delivery chain 10, changes its grippers in the order of first drying cylinder 11→second drying cylinder 12→first checking cylinder 17→second checking cylinder 18, and further in the order of transfer cylinder 23→transfer cylinder 24→transfer cylinder 25. Then, the sheet W is transported from the delivery cylinder 27 toward the delivery cylinder 28 by the second delivery chain 29, and dropped onto the acceptable product pile board 31 or the defective product pile board 32.

During transport of the sheet W on the first drying cylinder 11, the ultraviolet curing ink printed on the face side of the sheet W is dried with the face-side UV device 15. Then, while the sheet W is being transported on the second drying cylinder 12, the ultraviolet curing ink printed on the reverse side of the sheet W is dried with the reverse-side UV device 16. Then, during transport of the sheet W on the first checking cylinder 17, the quality of the face side of the sheet W is checked by the face-side checking camera 21. Then, during transport of the sheet W on the second checking cylinder 18, the quality of the reverse side of the sheet W is checked by the reverse-side checking camera 22.

According to the present embodiment, the drying cylinders 11 and 12 and the checking cylinders 17 and 18 are provided separately for the face side and the reverse side of the sheet W, and each of these cylinders is formed with a large diameter (twice the diameter of the plate cylinder 4 (normally 300 mm)). Thus, the face-side checking camera 21 adjacent to the reverse-side UV device 16 is spaced by a sufficient distance from the reverse-side UV device 16, and so is not adversely affected by the heat of the reverse-side UV device 16. Ultraviolet radiation from the reverse-side UV device 16 is also blocked by the drying cylinder 12 and the checking cylinder 17, and thus does not enter the face-side checking camera 21 (and the reverse-side checking camera 22).

Consequently, the improper operation and wrong detection of the face-side checking camera 21 (and the reverse-side checking camera 22) are prevented to increase the reliability of the printing quality checking apparatus.

Second Embodiment

Figure 3:
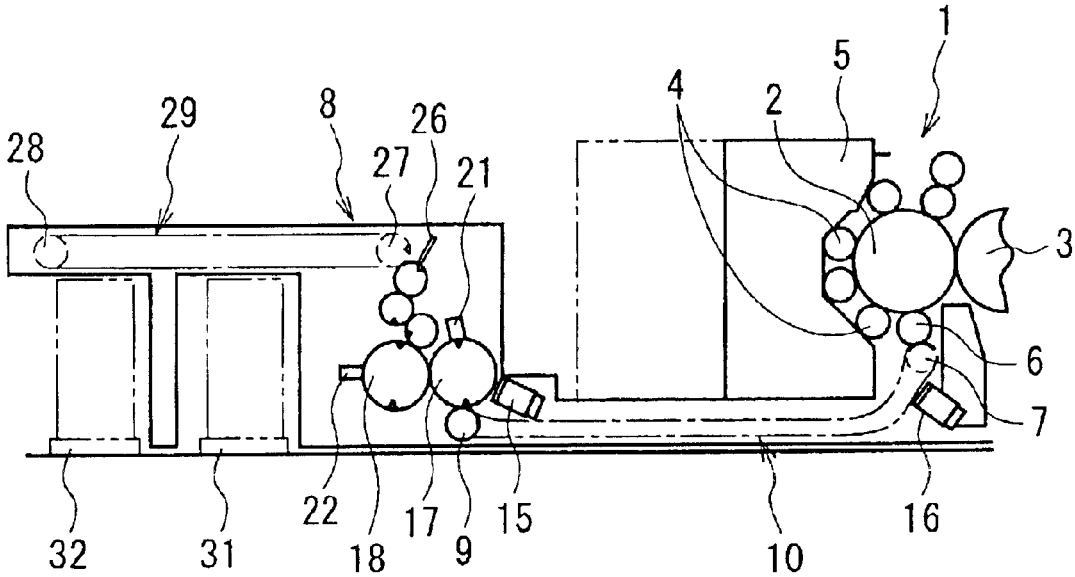
FIG. 3 is a side view of the essential parts of a four-color perfecting printing press showing a second embodiment of the present invention.
Figure 4:
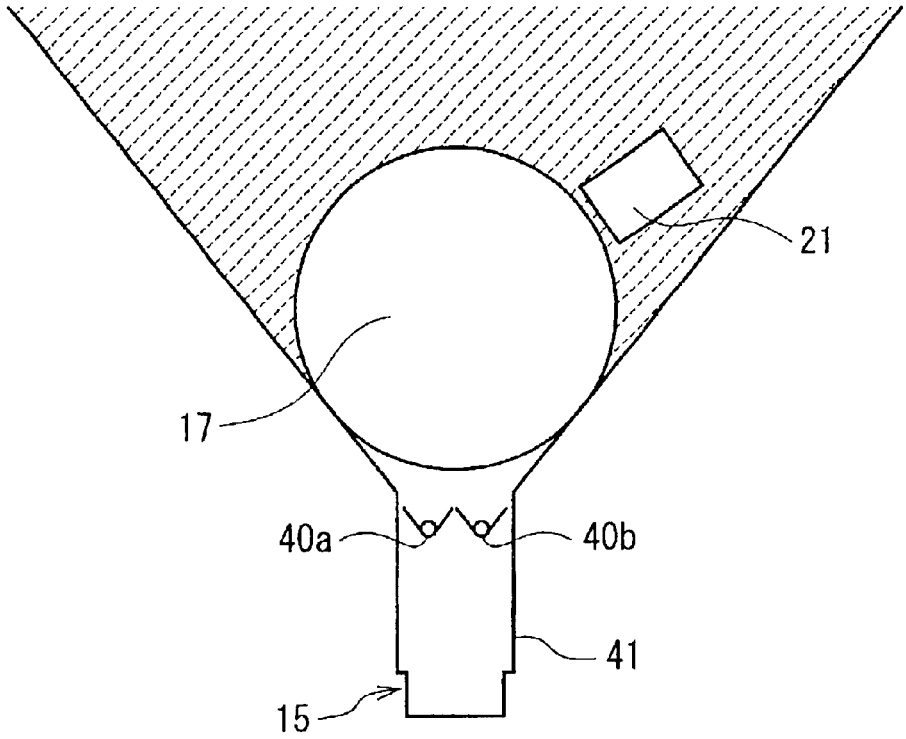
FIG. 4 is an explanatory drawing of the principle of camera installation.

FIG. 3 is a side view of the essential parts of a four-color perfecting printing press showing a second embodiment of the present invention. FIG. 4 is an explanatory drawing of the principle of camera installation.

This is an embodiment in which the drying cylinders 11 and 12 in the first embodiment are abolished; the reverse-side UV device 16 is provided opposing the transfer path of the first delivery chain 10; and the face-side UV device 15 is provided opposing the circumferential surface of the first checking cylinder 17 such that ultraviolet radiation from the face-side UV device 15 is blocked by the first checking cylinder 17 and is prevented thereby from entering the face-side checking camera 21.

That is, the positional relation between the face-side UV device 15 and the face-side checking camera 21 may be such that ultraviolet radiation from the face-side UV device 15, equipped with two lamps 40*a* and 40*b* and a lamp cover 41, is blocked by the first checking cylinder 17 to shade an area where the camera can be installed (in the drawing, an area hatched by dashed lines, and the face-side checking camera 21 is situated in this area, as shown in FIG. 4). Other constructions are the same as that in the first embodiment. The same members as those shown in FIG. 1 are assigned the same numerals, and duplicate explanations are omitted.

In addition to the same actions and effects as in the first embodiment, the present embodiment has the advantage that the anti-setoff sheet is unnecessary on the circumferential surface of the first checking cylinder 17.

Third Embodiment

Figure 5:
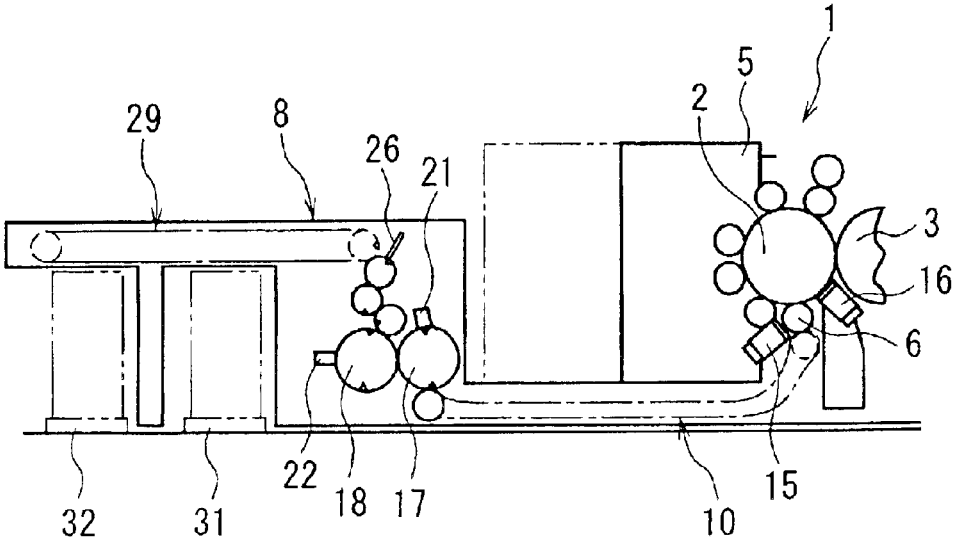
FIG. 5 is a side view of the essential parts of a four-color perfecting printing press showing a third embodiment of the present invention.

FIG. 5 is a side view of the essential parts of a four-color perfecting printing press showing a third embodiment of the present invention.

This is an embodiment, in which the blanketed impression cylinder 2 in the second embodiment, is used as a transport cylinder, the reverse-side UV device 16 is provided opposing the circumferential surface of the transport cylinder 2, the transfer cylinder 6 is used as a transport cylinder, and the face-side UV device 15 is provided opposing the circumferential surface of the transport cylinder 6. Since other constructions are the same as that in the second embodiment, the same members as those shown in FIG. 3 are assigned the same numerals, and duplicate explanations are omitted.

According to the present embodiment, the same actions and effects as in the second embodiment are obtained.

Fourth Embodiment

Figure 6:
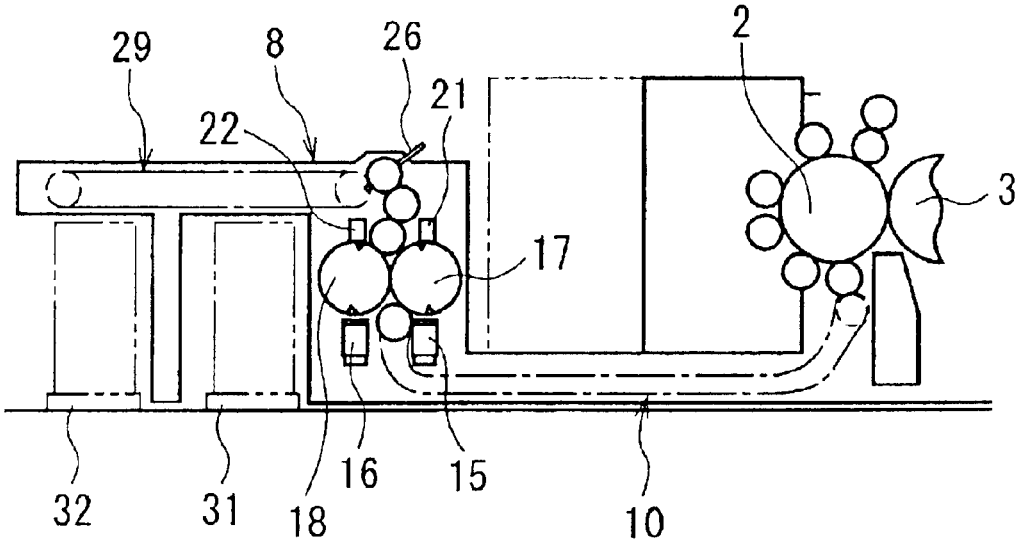
FIG. 6 is a side view of the essential parts of a four-color perfecting printing press showing a fourth embodiment of the present invention.

FIG. 6 is a side view of the essential parts of a four-color perfecting printing press showing a fourth embodiment of the present invention.

This is an embodiment, in which the face-side UV device 15 and the face-side checking camera 21 in the second embodiment are provided at positions in point symmetry around the circumferential surface of the first checking cylinder 17, and the reverse-side UV device 16 and the reverse-side checking camera 22 in the second embodiment are provided at positions in point symmetry around the circumferential surface of the second checking cylinder 18. Since other constructions are the same as those in the second embodiment, the same members as in FIG. 3 are assigned the same numerals, and duplicate explanations are omitted.

According to the present embodiment, the same actions and effects as in the second embodiment are obtained, except that an anti-setoff sheet (not shown) is necessary on the circumferential surface of the first checking cylinder 17.

Fifth Embodiment

Figure 7:
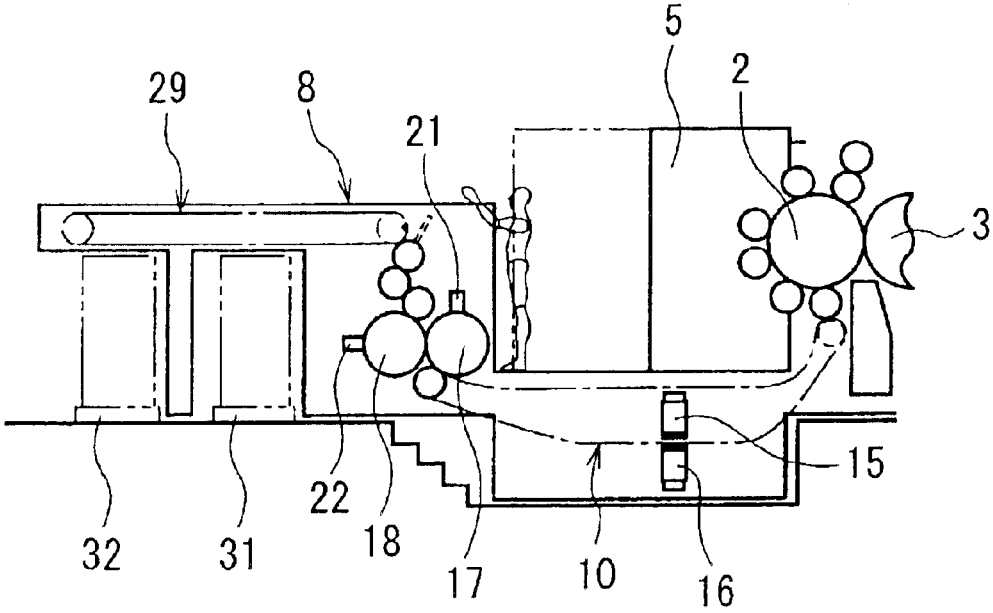
FIG. 7 is a side view of the essential parts of a four-color perfecting printing press showing a fifth embodiment of the present invention.

FIG. 7 is a side view of the essential parts of a four-color perfecting printing press showing a fifth embodiment of the present invention.

This is an embodiment in which the face-side UV device 15 and the reverse-side UV device 16 in the second embodiment are provided opposing each other in the intermediate portion of the first delivery chain 10. Since other constructions are the same as those in the second embodiment, the same members as those shown in FIG. 3 are assigned the same numerals, and duplicate explanations are omitted.

According to the present embodiment, the same actions and effects as in the second embodiment are obtained.

Sixth Embodiment

Figure 8:
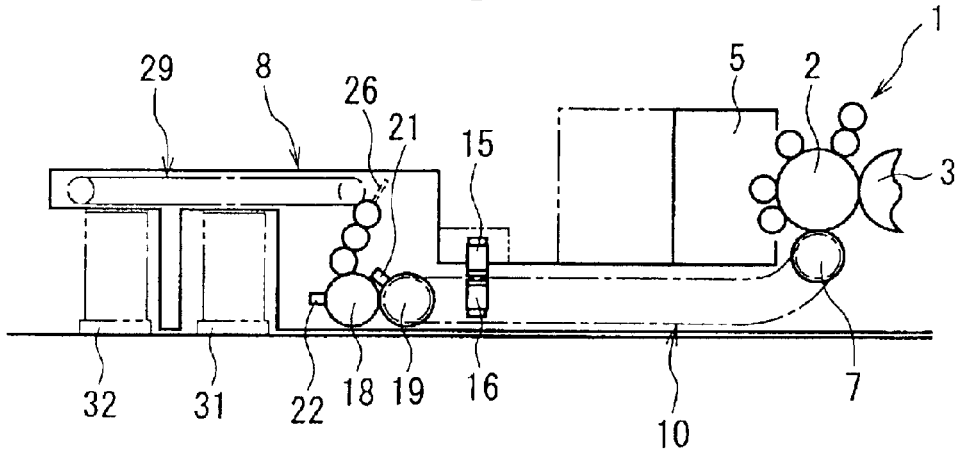
FIG. 8 is a side view of the essential parts of a three-color perfecting printing press showing a sixth embodiment of the present invention.

FIG. 8 is a side view of the essential parts of a three-color perfecting printing press showing a sixth embodiment of the present invention.

This is an embodiment, in which the four-color perfecting printing press in the second embodiment is applied as a three-color printing press; the first checking cylinder 17 is replaced by a delivery cylinder 19 of the delivery unit 8; and the face-side UV device 15 and the reverse-side UV device 16 are provided opposing each other in the intermediate portion of the first delivery chain 10. Other constructions are the same as those in the second embodiment, except that the delivery cylinder 7 and the delivery cylinder 19 are formed with a large diameter. Thus, the same members as those shown in FIG. 3 are assigned the same numerals, and duplicate explanations are omitted.

In addition to the same actions and effects as in the second embodiment, the present embodiment has the advantage that the first checking cylinder 17 is unnecessary.

Seventh Embodiment

Figure 9:
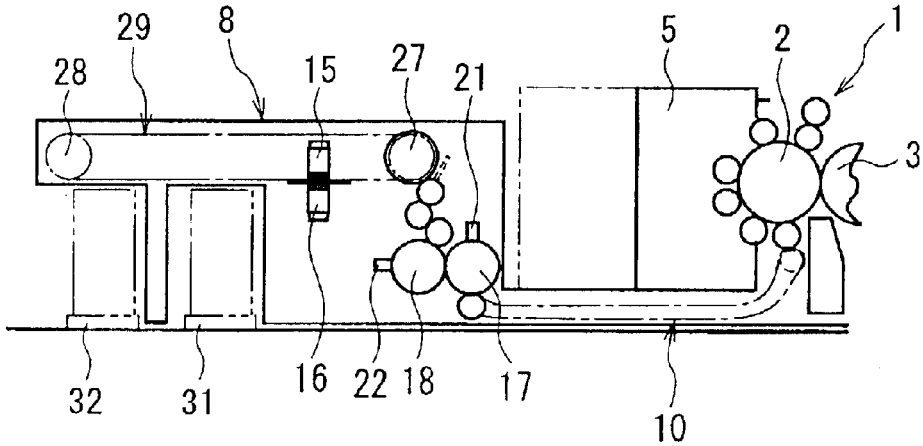
FIG. 9 is a side view of the essential parts of a four-color perfecting printing press showing a seventh embodiment of the present invention.

FIG. 9 is a side view of the essential parts of a four-color perfecting printing press showing a seventh embodiment of the present invention.

This is an embodiment, in which the face-side UV device 15 and the reverse-side UV device 16 in the second embodiment are provided opposite each other in an intermediate portion of the second delivery chain 29. Other constructions are the same as those in the second embodiment, except that the delivery cylinder 27 and the delivery cylinder 28 are formed with a large diameter. Thus, the same members as those shown in FIG. 3 are assigned the same numerals, and duplicate explanations are omitted.

According to the present embodiment, the same actions and effects as in the second embodiment are obtained, except that anti-setoff sheets (not shown) are necessary on the circumferential surfaces of the first checking cylinder 17 and the second checking cylinder 18. In addition, the distance between the drying unit and the checking unit can be further increased by increasing the length of the second delivery chain 29.

Eighth Embodiment

Figure 10:
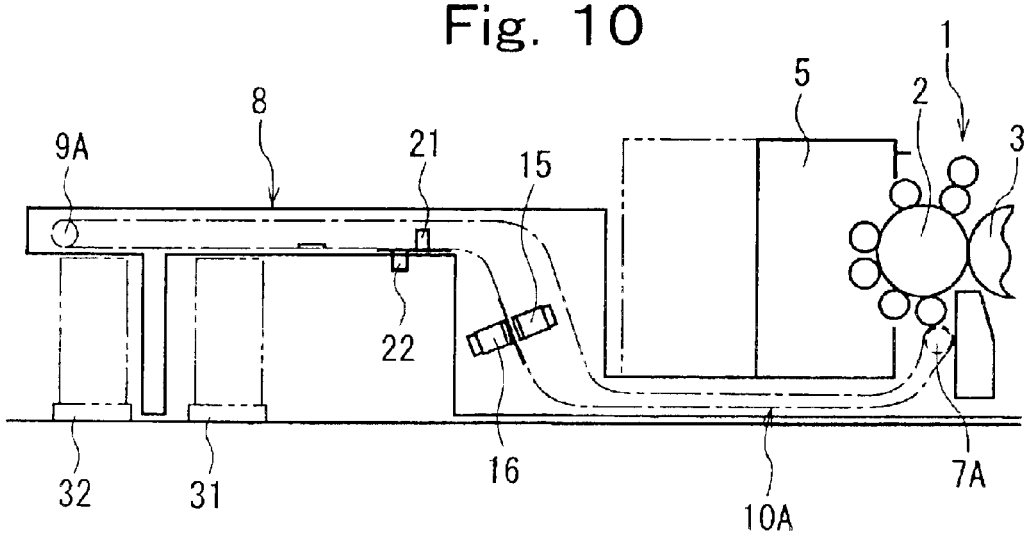
FIG. 10 is a side view of the essential parts of a four-color perfecting printing press showing an eighth embodiment of the present invention.

FIG. 10 is a side view of the essential parts of a four-color perfecting printing press showing an eighth embodiment of the present invention.

This is an embodiment, in which the drying cylinders 11, 12, checking cylinders 17, 18, and transfer cylinders 23, 24, 25 in the first embodiment are abolished in the delivery unit 8; a delivery chain (endless transport device) 10A extending from the printing unit 1 to the delivery unit 8 is uninterruptedly looped between delivery cylinders 7A and 9A; and the face-side UV device 15 and the reverse-side UV device 16 are provided opposing each other, and the face-side checking camera 21 and the reverse-side checking camera 22 are similarly provided substantially opposing each other, in an intermediate portion of the delivery chain 10A. The distance between the face-side UV device 15/reverse-side UV device 16 and the face-side checking camera 21/reverse-side checking camera 22 is at least 500 mm, preferably 1,000 mm or more. Other constructions are the same as those in the first embodiment. Thus, the same members as those shown in FIG. 1 are assigned the same numerals, and duplicate explanations are omitted.

In addition to the same actions and effects as in the first embodiment, the present embodiment has the advantage that since no cylinder is used in the delivery unit 8, the printing press can be constructed at a low cost, and the drive system can be realized without use of a separate drive (namely, the drive system may be a conventional chain drive). In addition, the distance between the drying unit and the checking unit can be further increased by increasing the length of the delivery chain 10A.

Ninth Embodiment

Figure 11:
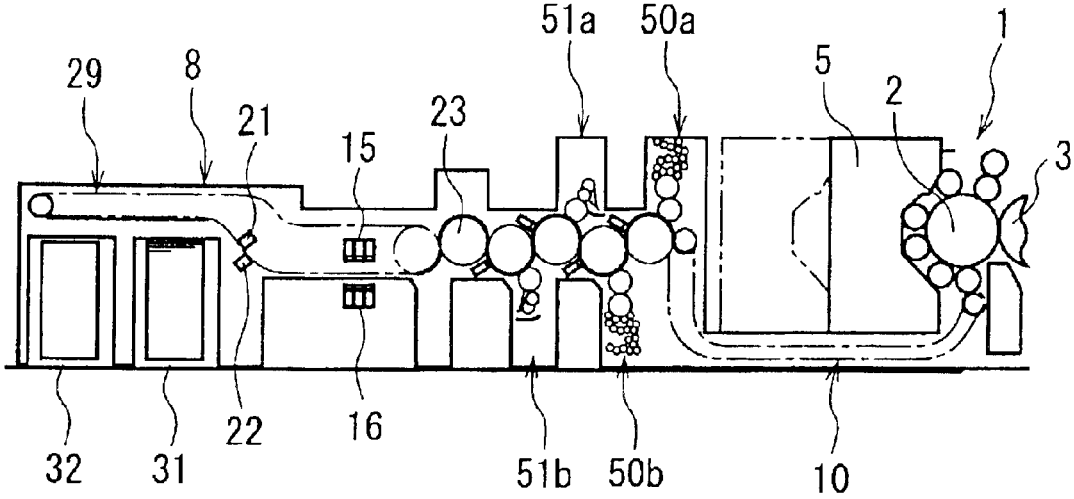
FIG. 11 is a side view of the essential parts of a five-color perfecting printing press showing a ninth embodiment of the present invention.

FIG. 11 is a side view of the essential parts of a five-color perfecting printing press showing a ninth embodiment of the present invention.

This is an embodiment, in which the four-color perfecting printing press in the first embodiment is applied as a five-color perfecting printing press having fifth-color face-side and reverse-side printing units 50*a* and 50*b*, and face-side and reverse-side coating units 51*a* and 51*b*; the face-side UV device 15 and the reverse-side UV device 16 are provided opposing each other, and the face-side checking camera 21 and the reverse-side checking camera 22 are similarly provided opposing each other, in the intermediate portion of the second delivery chain 29; and the drying cylinders 11, 12, and checking cylinders 17, 18 are abolished. The distance between the face-side UV device 15/reverse-side UV device 16 and the face-side checking camera 21/reverse-side checking camera 22 is at least 500 mm, preferably 1,000 mm or more. Other constructions are the same as those in the first embodiment, except that one transfer cylinder 23 is provided. Thus, the same members as those shown in FIG. 1 are assigned the same numerals, and duplicate explanations are omitted.

According to the present embodiment, the same actions and effects as in the first embodiment are obtained.

Tenth Embodiment

Figure 12:
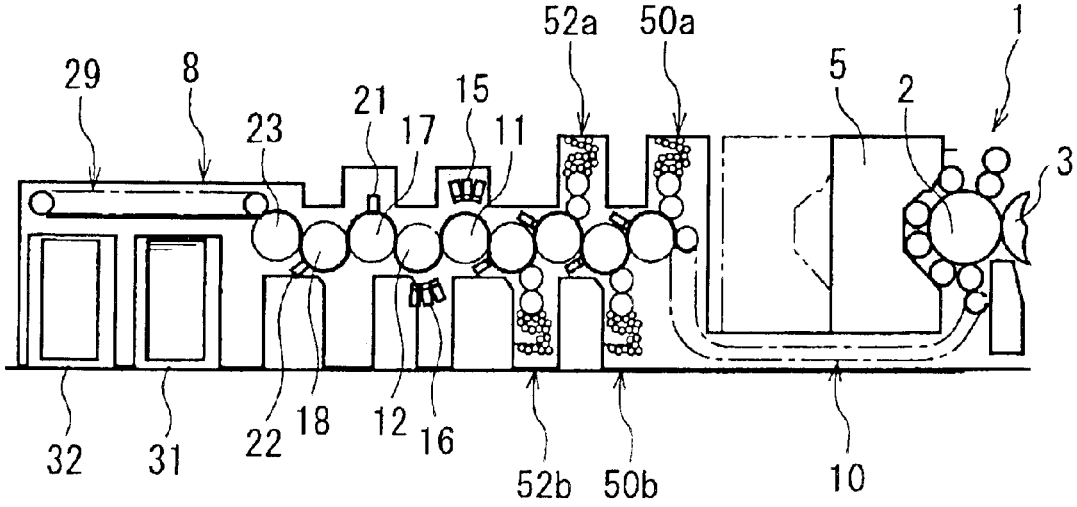
FIG. 12 is a side view of the essential parts of a six-color perfecting printing press showing a tenth embodiment of the present invention.
Figure 13:
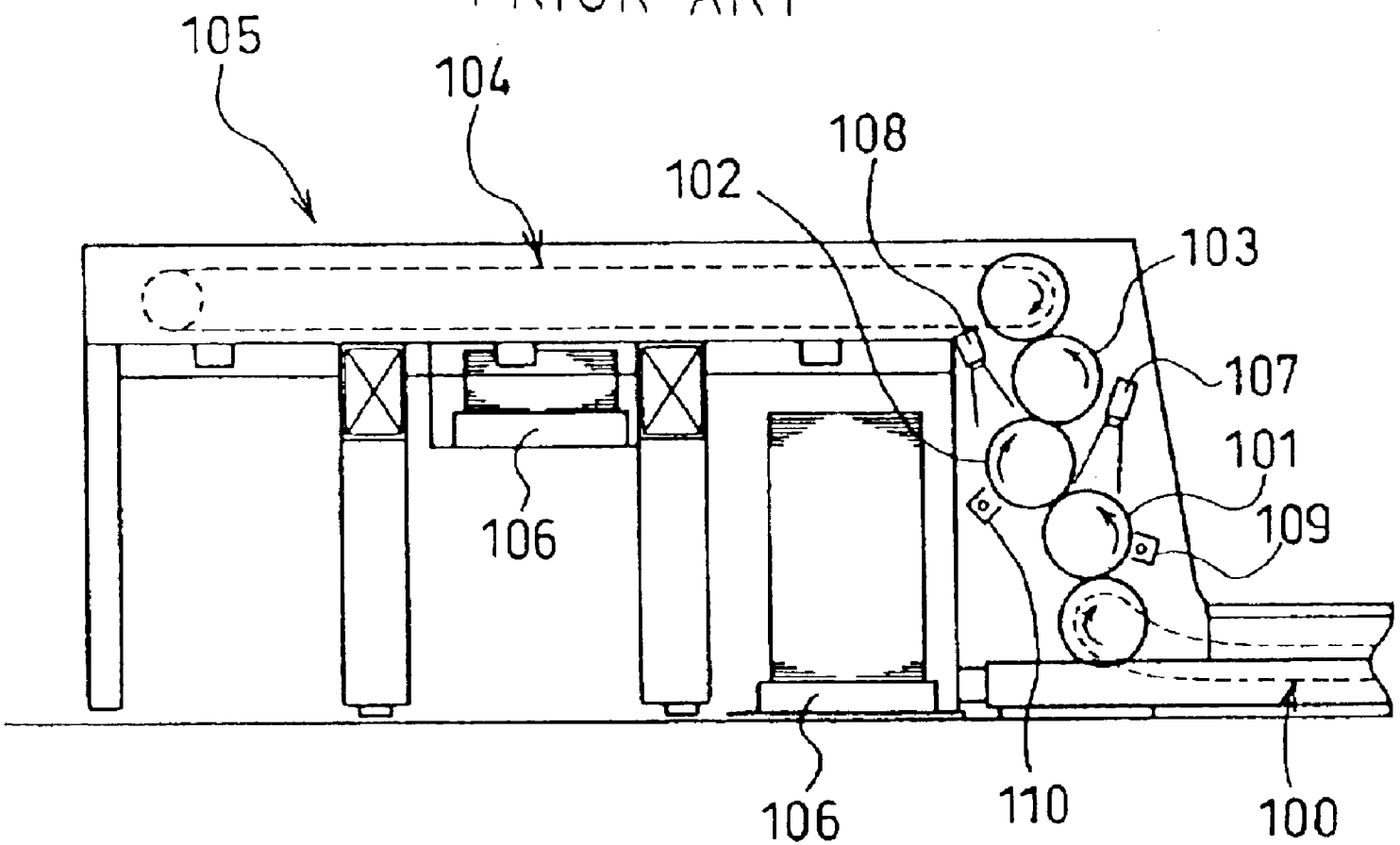
Fig. 13 PRIOR ART
FIG. 13 is a side view of the essential parts of a conventional perfecting printing press.

FIG. 12 is a side view of the essential parts of a six-color perfecting printing press showing a tenth embodiment of the present invention.

This is an embodiment, in which the four-color perfecting printing press in the first embodiment is applied as a six-color perfecting printing press having fifth-color face-side and reverse-side printing units 50*a* and 50*b*, and sixth-color face-side and reverse-side printing units 52*a* and 52*b*. Other constructions are the same as those in the first embodiment, except that one transfer cylinder 23 is provided. Thus, the same members as those shown in FIG. 1 are assigned the same numerals, and duplicate explanations are omitted.

According to the present embodiment, the same actions and effects as in the first embodiment are obtained.

While the present invention has been described by the foregoing embodiments, it is to be understood that the invention is not limited thereby, but may be varied in many other ways. For example, the face-side and reverse-side UV devices 15 and 16, and the face-side and reverse-side checking cameras 21 and 22 may be provided in reverse order. Furthermore, the present invention is not limited to a perfecting printing press, but may be applied to a one-side printing press. Such variations are not to be regarded as a departure from the spirit and scope of the invention, and all such modifications as would be obvious to one skilled in the art are intended to be included within the scope of the appended claims.

What is claimed is:

1. A printing quality checking apparatus of a printing press, said printing press comprising:

transport means for transporting a printing product, produced by printing, to a delivery unit;

a drying device for drying ink printed on one of the surfaces of said printing product transported by said transport means; and said printing quality checking apparatus for checking said one of the printed surfaces of said printing product transported by said transport means, and wherein said transport means includes at least two transport cylinders, said drying device is provided opposing a circumferential surface of one of said transport cylinders, and said detector of said printing quality checking apparatus is provided opposing a circumferential surface of the other transport cylinder.

2. The printing quality checking apparatus of a printing press according to claim 1, wherein said at least two transport cylinders have a larger diameter than a diameter of an ordinary plate cylinder.

3. A printing quality checking apparatus of a printing press, said printing press comprising:

transport means for transporting a printing product, produced by printing, to a delivery unit;

a drying device for drying ink printed on said printing product transported by said transport means; and said printing quality checking apparatus for checking a printed surface of said printing product transported by said transport means, wherein said transport means includes at least one transport cylinder, said drying device is provided opposing a circumferential surface of said transport cylinder, and a detection surface of said detector of said printing quality checking apparatus is provided in a range in which light from said drying device is blocked by said transport cylinder.

4. A printing quality checking apparatus of a printing press, said printing press comprising:

transport means for transporting a printing product, produced by printing, to a delivery unit;

a drying device for drying ink printed on said printing product transported by said transport means; and said printing quality checking apparatus for checking a printed surface of said printing product transported by said transport means, wherein said transport means includes at least one transport cylinder and at least one endless transport device, said drying device is provided opposing a transport path of said endless transport device, and said detector of said printing quality checking apparatus is provided opposing a circumferential surface of said transport cylinder.

5. A printing quality checking apparatus of a printing press, said printing press comprising:

transport means for transporting a printing product, produced by printing, to a delivery unit;

a drying device for drying ink printed on said printing product transported by said transport means; and said printing quality checking apparatus for checking a printed surface of said printing product transported by said transport means, wherein said transport means includes at least one endless transport device, said drying device is provided opposing a transport path of said endless transport device, and said detector of said printing quality checking apparatus is provided opposing said transport path of said endless transport device, and is provided at a position 500 mm or more apart from a position of said drying device.

6. A printing quality checking apparatus of a printing press, said printing press comprising:

first and second transport cylinders for transporting a printed product to a delivery unit;

a dryer for drying ink printed on a first side of said printed product and opposing a circumferential surface of said first transport cylinder; and a print quality detector for detecting the print quality of said ink printed on said first side of said printed product and opposing a circumferential surface of said second transport cylinder.

7. The printing quality checking apparatus of claim 6 wherein said print quality detector is mounted such that said print quality detector is not affected by heat of said drying device.

8. The printing quality checking apparatus of claim 6 wherein said print quality detector is mounted such that said print quality detector is not affected by light of said drying device.

9. The printing quality checking apparatus of claim 6 wherein said printing press is a perfecting printing press.

10. A printing quality checking apparatus of a printing press, said printing press comprising:

first and second transport cylinders for transporting a printed product printed on first and second sides to a delivery unit;

a first dryer for drying ink printed on said first side of said printed product;

a second dryer for drying ink printed on said second side of said printed product;

a first detector for checking the printing on said first surface of said printed product; and a second detector for checking the printing on said second surface of said printed product;

wherein said first and second detectors are mounted at first and second positions where said detectors are not affected by heat of said dryer.

11. The printing quality checking apparatus of claim 10 wherein said first and second detectors mounted at said first and second positions are not affected by light from said dryers.

12. The printing quality checking apparatus of claim 10 wherein said first dryer is mounted opposing a circumferential surface of said first transport cylinder and said second dryer is mounted opposing a circumferential surface of said second transport cylinder.

* * * * *